US005718415A

United States Patent [19]

Dainton

[11] Patent Number: 5,718,415

[45] Date of Patent: Feb. 17, 1998

[54] FLOW CONTROL DEVICE FOR THE OUTLET NOZZLE OF A METALLURGICAL VESSEL

[75] Inventor: Albert Edward Dainton, Medina, Ohio

[73] Assignee: Foseco International Limited, Wiltshire, England

[21] Appl. No.: 793,781

[22] PCT Filed: Aug. 16, 1995

[86] PCT No.: PCT/GB95/01934

§ 371 Date: Mar. 5, 1997

§ 102(e) Date: Mar. 5, 1997

[87] PCT Pub. No.: WO96/07495

PCT Pub. Date: Mar. 14, 1996

[30] Foreign Application Priority Data

Sep. 10, 1994 [GB] United Kingdom ..... 9418291

[51] Int. Cl.[6] ..... B22D 41/44

[52] U.S. Cl. ..... 266/45; 222/590; 222/594; 222/597; 266/230; 266/271

[58] Field of Search ..... 266/44, 45, 227, 266/228, 230, 271, 272; 222/590, 591, 594, 597

[56] References Cited

U.S. PATENT DOCUMENTS

| | | | |
|---|---|---|---|
| 743,549 | 11/1903 | O'Connor | 222/597 |
| 4,913,314 | 4/1990 | Otsuka et al. | 266/271 |
| 5,083,754 | 1/1992 | Russo | 266/227 |
| 5,164,098 | 11/1992 | Brown et al. | 266/271 |

FOREIGN PATENT DOCUMENTS

| | | | |
|---|---|---|---|
| 0280270 | 7/1990 | Germany | 222/600 |
| 2022794 | 12/1979 | United Kingdom . | |
| 8000546 | 4/1980 | WIPO | 222/597 |
| 9413840 | 6/1994 | WIPO . | |

*Primary Examiner*—Scott Kastler

*Attorney, Agent, or Firm*—Nixon & Vanderhye P.C.

[57] ABSTRACT

A flow control device for the outlet nozzle for a molten metal handling vessel, such as a ladle, includes a plug that fits in the outlet nozzle to define a gap between the plug and a closure for the nozzle. The plug has a plurality of apertures which are closed by steel plates, or other material, that melts under the influence of the molten metal in the vessel. When molten metal is placed into the vessel and the closure for the outlet is opened, the molten metal flows into the apertures, melting the meltable material in the apertures, and out the outlet. Using a device and method described allows the amount of molten metal in a ladle to be reduced to about 0.5%, and a greater than 99% free opening rate can be provided.

20 Claims, 5 Drawing Sheets

FLOW CONTROL DEVICE FOR THE OUTLET NOZZLE OF A METALLURGICAL VESSEL

BACKGROUND AND SUMMARY OF THE INVENTION

This invention relates to a molten metal handling vessel and particularly to a means of improving the opening of the outlet nozzle of the vessel containing molten metal to allow the metal to flow out. The invention is especially, concerned with the teeming of molten steel from a ladle and, although not intended to be limited thereto, it will be more specifically described below with, reference to ladles.

In the steel industry, ladles are used to transfer molten metal from the melting and refining vessels to continuous casters or an ingot teeming bay The metal flow from the ladle is controlled typically by a slide gate valve. Usually, the outlet nozzle area is filled with a refractory sand introduced from the top of the ladle to prevent steel freezing in the nozzle cavity before teeming commences. This is accomplished in a variety of ways, either manually or semi-automatically.

However, all conventional methods have been found to be inconsistent and usually result in number of failures to open. The term "free open" refers to a totally successful opening without the need to flush the nozzle with oxygen to break the formed steel/sand skull. Free opening success rate varies from mill to mill but is usually in the range 80–90%. At the end of the cast, the ladle is closed by visually observing slag in the tundish or by detecting slag using devices sensitive to slag transfer.

At the lower levels of steel in the vessel, vortex formation can occur resulting in significant slag carry-over or the need to carry sizeable quantities of steel in the ladle at the end of teeming. Slag carry-over causes a variety of problems at the caster which usually result in quality problems as well as causing difficulties with consistent repeating of the ladle and filling sequence.

It is an object of the invention to provide an improved means of opening the outlet nozzle of a molten metal handling vessel particularly a ladle, whereby the free opening success rate may be increased.

Accordingly, in one aspect the invention provides a flow control device for the outlet nozzle of a molten metal handling vessel, the device being shaped to fit as a plug in the outlet nozzle whereby a gap is defined between the device and the closure means for the outlet, the device having apertures closed by means that melt under the influence of the molten metal in the vessel, the apertures providing passageway for the molten metal from the vessel to the outlet.

The means to close the apertures may be vented steel plates that melt under the influence of the molten metal—steel—with which the vessel is filled.

The flow control device is preferably a press-fit into the top portion of a suitably contoured ladle inner nozzle and may be a disposable item that is discarded after each teeming of the ladle.

The gap between the device and the closure means of the vessel, i.e. usually a slide gate valve in a ladle, may be filled with sand which may be blown into the gap through the open slide gate valve, preferably while the empty ladle has been rotated to its horizontal position, i.e. normal to its vertical metal-containing position. The slide gate valve may then be closed and the ladle rotated to its normal vertical position to be filled with molten metal.

Accordingly in another aspect the invention provides a method of teeming a molten metal handling vessel in which a flow control device is fitted as a plug into the outlet nozzle of the empty vessel, whereby a gap is defined between the device and the closure means for the outlet, the device having apertures closed by means that melt under the influence of molten metal in the vessel, the gap is filled with sand through the closure means for the outlet, the closure means is closed and the vessel is filled with molten metal, whereby the molten metal melts the means closing the apertures of the device, and the outlet closure is opened to teem the vessel.

The flow control device preferably comprises a head portion containing the apertures and a tail portion shaded to be a close fit into the correspondingly contoured entrance of the outlet of the vessel, i.e. into the outlet nozzle. It may be mortared into a press fit in the outlet and may be placed in the desired position in the hot vessel e.g. by a mechanical arm from the top of the ladle or by an operator suitably protected by an insulating barrier. A camera may be used to ensure accurate placement.

The head of the flow control device preferably sits proud of the floor of the vessel so that it is fully pre-heated with the vessel and will not cause freezing of the molten metal poured into the vessel.

As the molten metal melts the closures of the apertures of the flow control device, it contacts the sand filling the gap above the outlet closure means and the sand will sinter at the molten metal/sand interface. When it is desired to teem the vessel, opening the outlet allows the unsintered sand to fall out and the metallostatic pressure above the sintered cad of sand breaks that cap and the metal flows out of the vessel.

The metal is then allowed to flow out until slag is detected. The transition from metal to slag is very sharp so that the invention provides improved sensitivity for slag detection, thereby eliminating or reducing premature cut-off.

At the end of teeming, the vessel may be de-slagged and the used flow control device is punched out of the nozzle to be replaced be a new device for the next sequence.

The device may be made of any suitable refractory composition, e.g. magnesia- or alumina-based refractories.

DETAILED DESCRIPTION OF THE DRAWINGS

Figure 1:
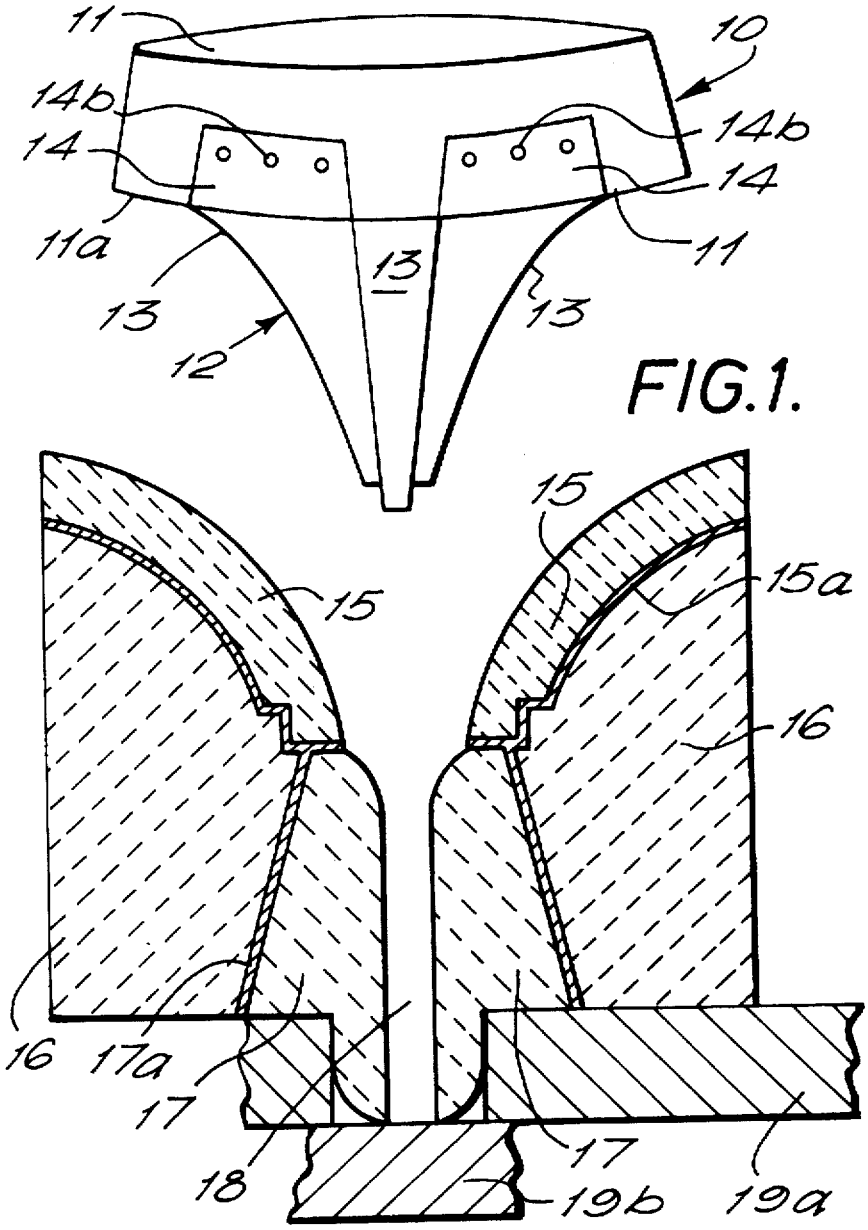
FIG. 1 is a representation of a device of the invention being positioned on an outlet in a ladle.

In FIG. 1 a flow control device 10 of the invention comprises a plug having a head portion 11 integrally-formed with a tail portion 12. Tail portion 12 comprises four equi-spaced fins 13 contoured to converge inwardly away from head 11. The contoured tail portion is designed to fit into a correspondingly-contoured split upper well block plate 15 fitted in a permanent well block 16 above a nozzle 17 defining an outlet 18 in a ladle. Outlet 18 passes through an upper slide gate plate **19*a* and is shown closed by a lower slide gate plate 19*b***, these being conventional closure means.

Graphitised mortar layers **15*a* and 17*a* respectively seal the upper well block plate 15 to permanent well block 16 and the nozzle 17 to the permanent well block 16**.

It will be appreciated that the flow control device 10 and upper well block plate 15 may instead be made in one-piece which is replaced after each heat. However, as shown, the upper well block plate 15 may be a semi-disposable item being replaced, for example, after 2 to 5 heats.

Metal closure sheets 14 are fitted to head 11 to close apertures formed by the castellated outline of the lower edge 11*a* of the head. The sheets, usually of steel, have vent holes 14*b* to allow upward venting through the outlet nozzle when the device is fitted in a ladle.

Use of the flow control device of FIG. 1 is now described with reference to FIGS. 2 to 8.

Figure 2:
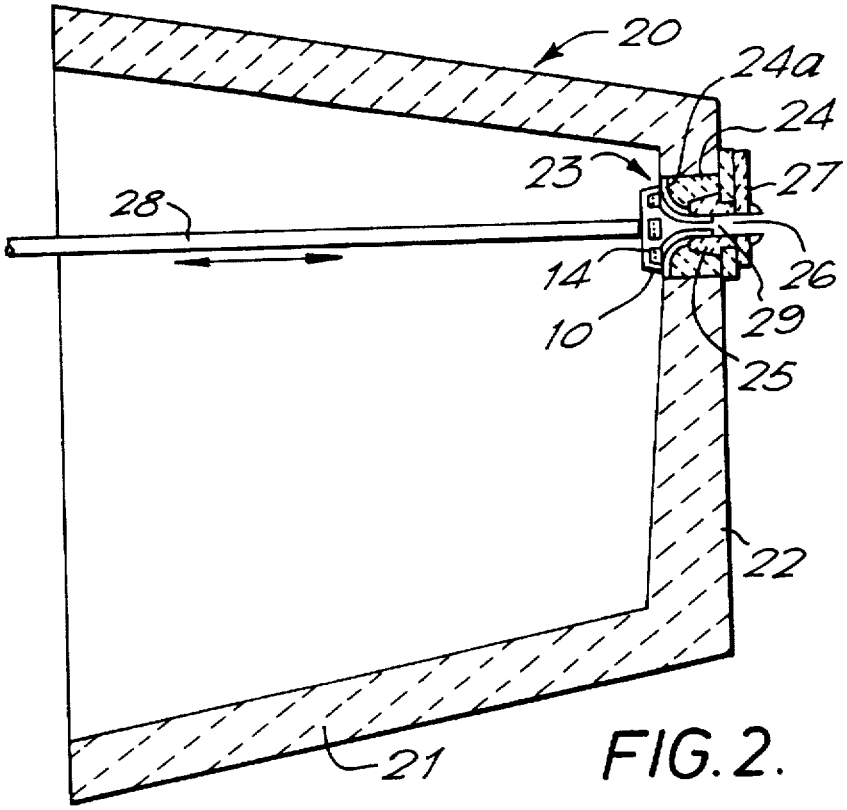
FIGS. 2, 3, 4, 5, 6, 7 and 8 are each diagrammatic sectional views through a ladle showing successive steps from introducing a device of the invention into an empty ladle through to removing the used device from the ladle after a sequence of filling the ladle with molten steel through to emptying the steel from the ladle.

In FIG. 2 an empty ladle 20 is shown rotated to its side or horizontal position. The ladle has walls 21 and a bottom 22. An outlet 23 in the bottom contains a well block 24 an inner nozzle 25 fitted in the well block to define an outlet passageway 26 and an upper well block plate 24*a* similar to plate 15 of FIG. 1.

A conventional slide gate valve 27 is attached to the outside of the bottom 21 of the ladle surrounding the outlet.

The upper surface of the upper well block plate 24*a* is contoured to receive the tail portion of flow control device 10 so that its head 11 stands proud of the surface of the bottom of the ladle. Device 10 is fitted into the ladle using a removable positioning arm 28 and is set in place in the top of the inner nozzle with mortar.

As can be seen in FIG. 2, the head 11 of the device and the closure plates 14 completely close off access to the outlet from inside the ladle but leave a gap or empty, volume 29 in the outlet between the device and the sliding gate valve.

Figure 3:
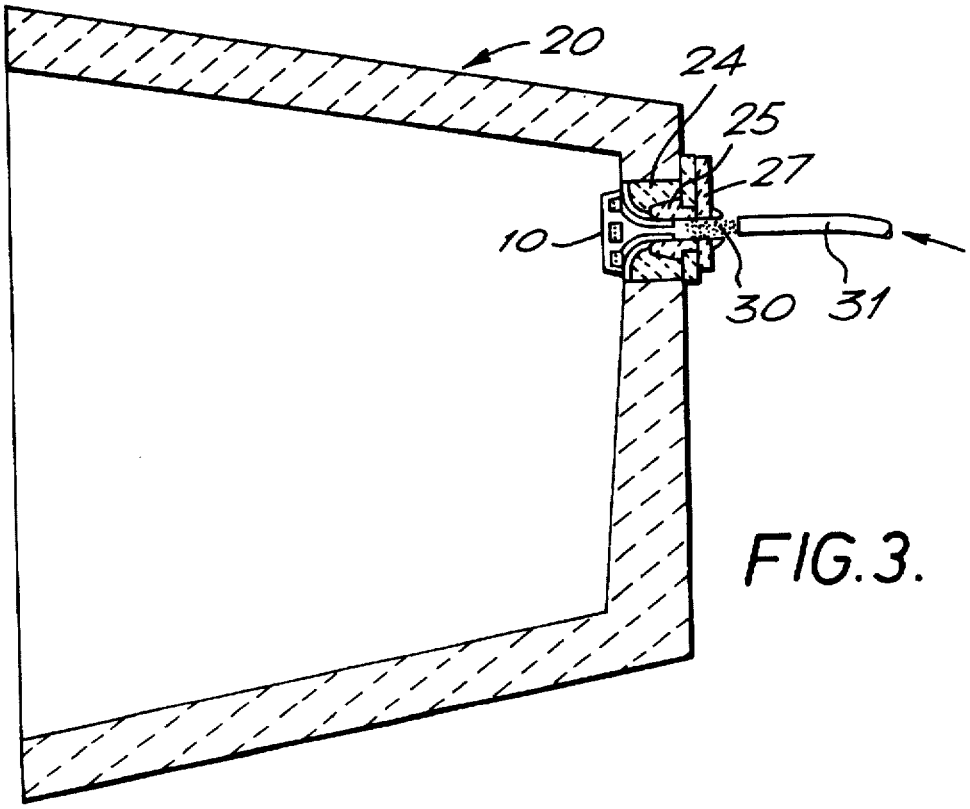

In FIG. 3, ladle sand 30 is shown being introduced into gap 29 through the open slide gate valve 27 using a hose 31 and blowing means (not shown).

Figure 4:
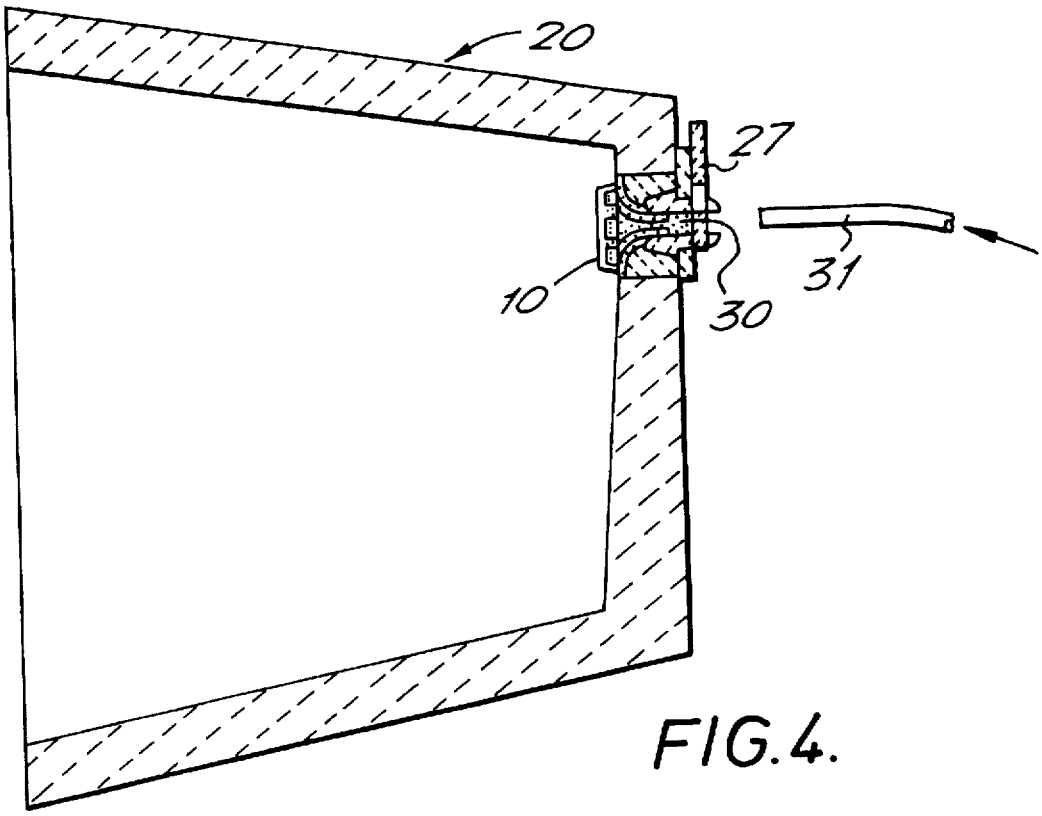

In FIG. 4 gap 29 has been filled with sand and the slide gate valve 27 has been closed.

Figure 5:
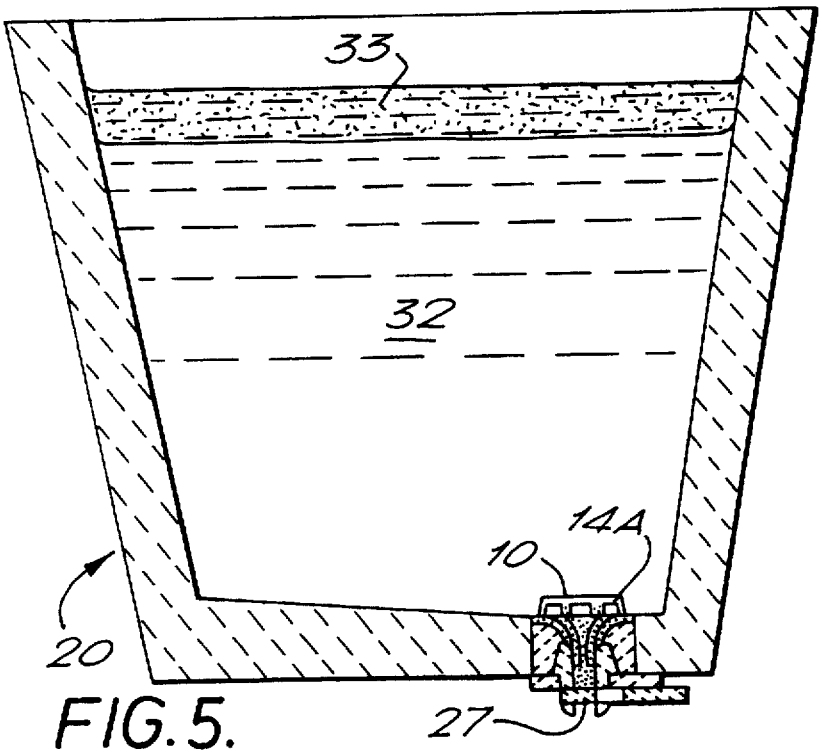

In FIG. 5 ladle 20 has been turned to its vertical position, pre-heated and filled with molten steel 32 covered by a slag layer 33. The slide gate valve 27 is still closed and the molten metal dissolves the closure plates 14 to expose apertures 14A through which it flows to contact the sand at the top of gap 29 to form a sintered cap of sand (not shown) at the sand/metal surface. The steel is refined and the ladle taken to the caster (not shown).

Figure 6:
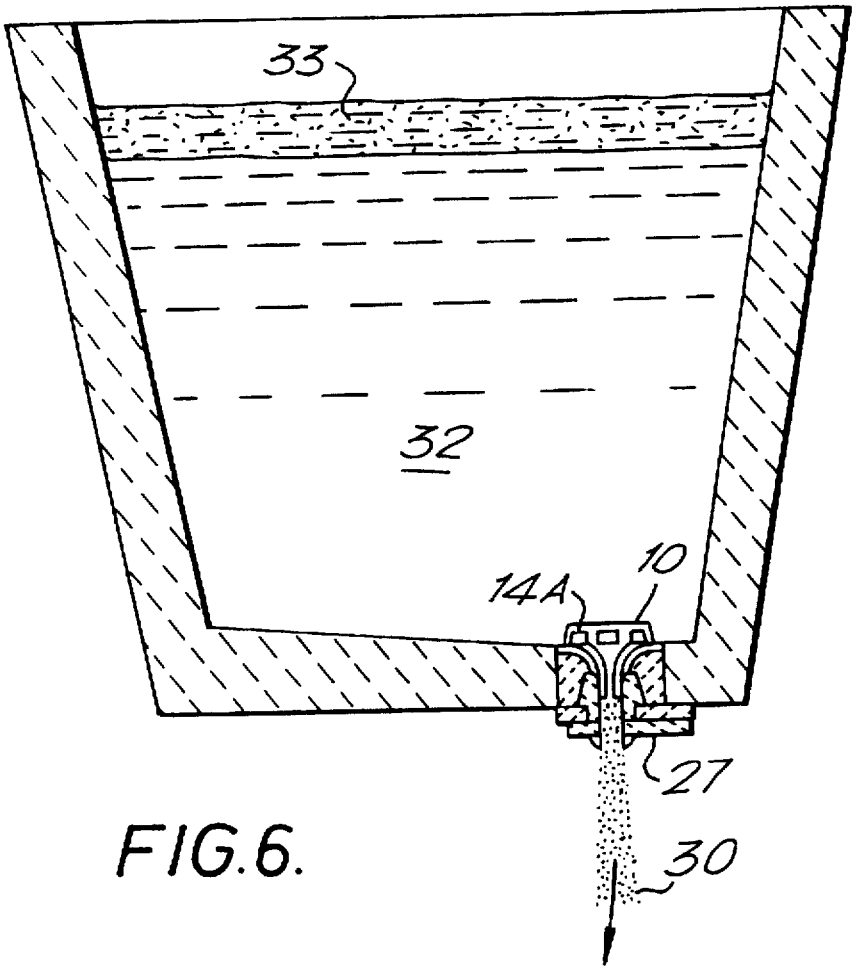

In FIG. 6, teeming of the steel from the ladle is commenced. Slide gate valve 27 is opened and the free sand 30 runs out. The pressure of the steel 32 above any sintered cap of sand breaks the cap and the steel can flow out through the outlet.

Figure 7:
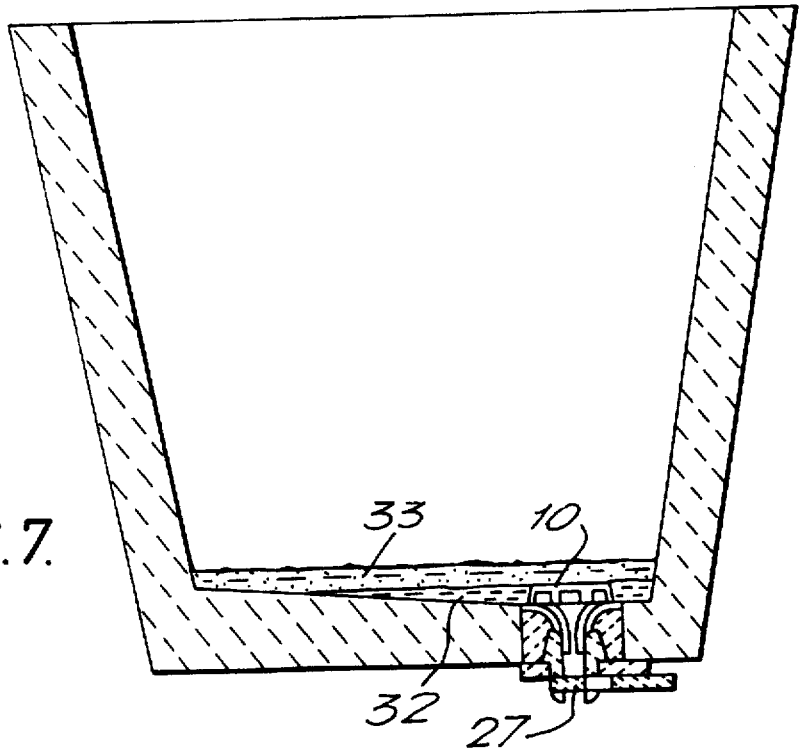

In FIG. 7 is shown the end of teeming. Slide gate valve 27 has been closed leaving the slag 33 and a very small mount of steel 32 in the ladle.

Figure 8:
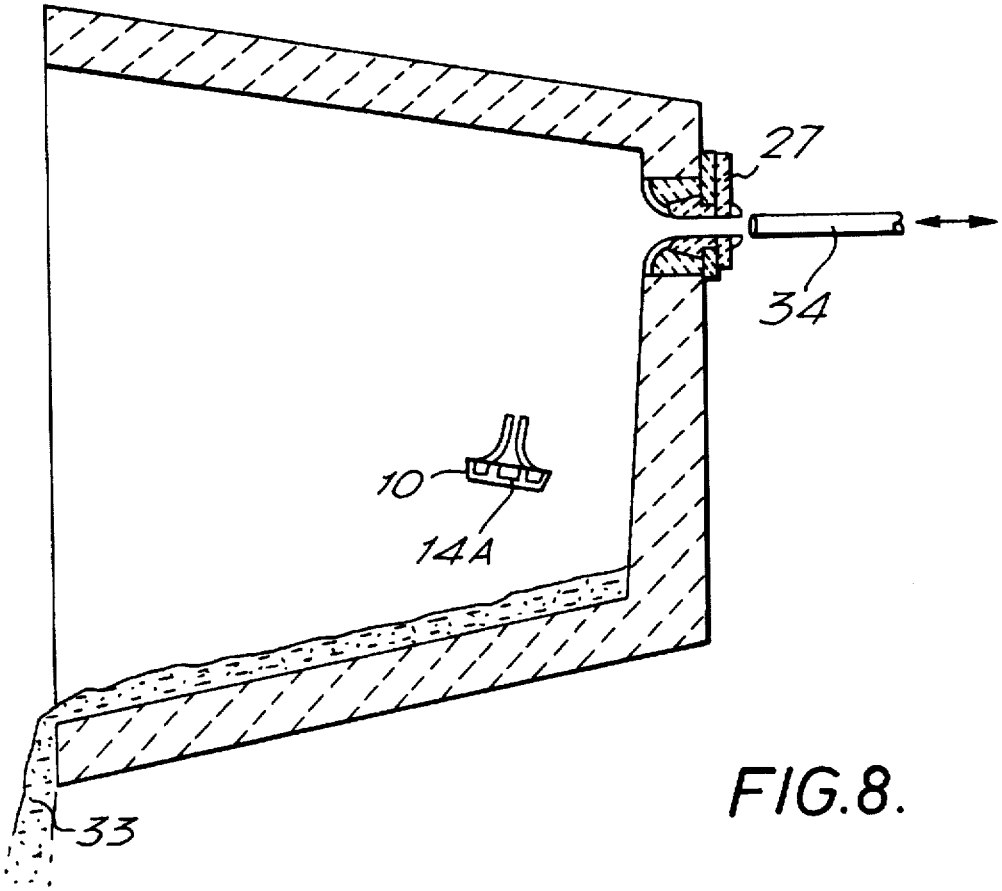

Finally, in FIG. 8, the nearly empty ladle 20 has been rotated into its side position. Slag 33 is removed and the flow control device 10 is punched out using punch 34 through the outlet.

In a typical conventional slab caster using ladles of 250 to 300 ton capacity, a free-opening rate of up to about 95% is usual. At the end of teeming about 1 to 3% of the steel is left in the ladle if high quality grade products are being made. The use of the invention as described above enables the steel left in the ladle to be reduced to about 0.5% and can give a virtually unheard of >99% free-opening rate.

I claim:

1. A flow control device for an outlet nozzle of a molten meal handling vessel having a closure means for an outlet from said outlet nozzle, said device comprising:

a plug shaped to fit in said outlet nozzle so that a gap is defined between said plug and said closure means;

said plug having a plurality of apertures therein; and said apertures closed by a material that melts under the influence of molten metal in said vessel, and upon melting allows flow of molten metal from said vessel to said outlet through said apertures.

2. A flow control device according to claim 1 wherein said material to close said apertures comprises steel plates that melt under the influence of the molten metal in the vessel.

3. A flow control device according to claim 2 wherein said steel plates have vent holes to allow upward venting when said plug is fitted in the vessel outlet nozzle.

4. A flow control device according to claim 1 wherein said vessel is a ladle, and wherein said plug is a press-fit into a top portion of a suitably contoured ladle inner nozzle.

5. A flow control device according to claim 1 wherein said plug is a disposable device to be discarded after one teeming of the vessel.

6. A flow control device according to claim 1 wherein said plug comprises a head portion containing the apertures and a tail portion shaped to be a close fit into the a correspondingly contoured entrance of the outlet.

7. A flow control device according to claim 6 wherein said head portion in use sits proud of the floor of the vessel.

8. A flow control device according to claim 6 wherein said apertures are defined by a castellated outline of the lower edge in use, of the head portion of said plug.

9. A method of teeming a molten metal handling vessel using a plug flow control device capable of being fitted in an outlet nozzle of the empty vessel so that a gap is defined between the plug and a closure for the outlet, the plug having a plurality of apertures closed by a material that melts under the influence of molten metal in the vessel, said method comprising the steps of:

(a) placing the plug in the outlet nozzle to define the gap;

(b) filling the gap with sand through the closure for the outlet;

(c) closing the closure for the outlet;

(d) after steps (a)–(c), placing molten metal in the vessel; and (e) after step (d), teeming the vessel by opening the closure so that molten metal flows into the plug apertures, melting the material that melts under the influence of molten metal therein, and through the apertures out of the outlet.

10. A method as recited in claim 9 wherein step (a) is practiced while the vessel is hot, and using a mechanical arm.

11. A method as recited in claim 10 wherein the plug is disposable; and comprising the further step of (f) after step (e) is practiced so that the vessel is teemed, punching out the plug and repeating steps (a)–(c) again before practicing steps (d) and (e) again.

12. A method as recited in claim 11 wherein the vessel is a ladle, and wherein step (e) is practiced to pour molten metal out of the ladle to another vessel.

13. A method as recited in claim 9 wherein the plug is disposable; and comprising the further step of (f) after step (e) is practiced so that the vessel is teemed, punching out the plug and repeating steps (a)–(c) again before practicing steps (d) and (e) again.

14. A method as recited in claim 9 wherein the vessel is a ladle, and wherein step (e) is practiced to pour molten metal out of the ladle to another vessel.

15. A flow control device according to claim 2 wherein said vessel is a ladle, and wherein said plug is a press-fit into a top portion of a suitably contoured ladle inner nozzle.

16. A flow control device according to claim 2 wherein said plug is a disposable device to be discarded after one teeming of the vessel.

17. A flow control device according to claim 2 wherein said plug comprises a head portion containing the apertures and a tail portion shaped to be a close fit into a correspondingly contoured entrance of the outlet.

18. A flow control device according to claim 17 wherein said head portion in use sits proud of the floor of the vessel.

19. A flow control device according to claim 17 wherein said apertures are defined by a castellated outline of the lower edge in use, of the head portion of said plug.

20. A flow control device according to claim 4 wherein said plug comprises a head portion containing the apertures and a tail portion shaped to be a close fit into a correspondingly contoured entrance of the outlet.

* * * * *

UNITED STATES PATENT AND TRADEMARK OFFICE

CERTIFICATE OF CORRECTION

PATENT NO. : 5,718,415

DATED : February 17, 1998

INVENTOR(S) : Dainton, Albert Edward

It is certified that error appears in the above-indentified patent and that said Letters Patent is hereby corrected as shown below:

In the Abstract of the Disclosure, please delete the entire Abstract and replace it with the following:

-- A flow control device for the outlet nozzle for a molten metal handling vessel, such as a ladle, includes a plug that fits in the outlet nozzle to define a gap between the plug and a closure for the nozzle. The plug has a plurality of apertures which are closed by steel plates, or other material, that melts under the influence of the molten metal in the vessel. When molten metal is placed into the vessel the molten metal flows through the apertures, melting the meltable material in the apertures, and -- when the closure is opened -- out the outlet. Using a device and method described allows the amount of molten metal in a ladle to be reduced to about 0.5%, and a greater than 99% free opening rate can be provided. --

Column 1, line 10 and line 13, delete the comma in both instances.

Column 2, line 31, change "cad" to -- cap --.

UNITED STATES PATENT AND TRADEMARK OFFICE

CERTIFICATE OF CORRECTION

PATENT NO. : 5,718,415

DATED : February 17, 1998

INVENTOR(S) : Dainton, Albert Edward

It is certified that error appears in the above-indentified patent and that said Letters Patent is hereby corrected as shown below:

Column 4, line 45 insert -- so that molten metal melts the material that melts under the influence of molten metal and flows through the plug apertures into contact with the sand -- after "vessel"; and line 48 through line 51, delete "into the plug apertures, melting the material that melts under the influence of molten metal therein, and through the apertures".

Signed and Sealed this

Twenty-third Day of June, 1998

Bruce Lehman

*Attest:*

BRUCE LEHMAN

*Attesting Officer*

*Commissioner of Patents and Trademarks*